313-422

SR

3/6/79 OR 4,143,296

United States Patent [19]

Stanley

[11] 4,143,296

[45] Mar. 6, 1979

[54] FLAT PANEL DISPLAY DEVICE

[75] Inventor: Thomas O. Stanley, Princeton, N.J.

[73] Assignee: RCA Corporation, New York, N.Y.

[21] Appl. No.: 804,007

[22] Filed: Jun. 6, 1977

[51] Int. Cl.[2] ..... H01J 29/70; H01J 29/80

[52] U.S. Cl. ..... 313/422

[58] Field of Search ..... 313/422, 400, 105 R, 313/409 (U.S. only)

[56] References Cited

U.S. PATENT DOCUMENTS

| | | | |
|---|---|---|---|
| 3,935,500 | 1/1976 | Oess et al. | 313/409 X |
| 3,976,635 | 9/1976 | Scott | 313/409 X |
| 4,028,582 | 6/1977 | Anderson et al. | 313/422 X |

*Primary Examiner*—Robert Segal

*Attorney, Agent, or Firm*—Eugene M. Whitacre; Glenn H. Bruestle; Donald S. Cohen

[57] ABSTRACT

An evacuated envelope having a plurality of parallel channels extending along and between spaced front and back walls. Each channel contains a plurality of parallel beam focusing guides, each of which is adapted to receive a beam of electrons at one end of the channel and confine the electrons in the beams as the beam flows through the focusing guide and to selectively deflect the beam toward a phosphor screen on the front wall of the envelope at a plurality of points along the channel. At each side of each channel is an electrode which extends from the front wall to a point spaced from the beam focusing guides. The electrodes are electrically connected to the phosphor screen and with the focusing guides serve to create an electrostatic field which fans out the paths of the electron beams emitted from the focusing guides so as to spread out the beams across the entire lateral dimension of the channel.

2 Claims, 2 Drawing Figures

FLAT PANEL DISPLAY DEVICE

BACKGROUND OF THE INVENTION

The present invention relates to a flat panel display device having a plurality of beam focusing guides for confining electrons in beams extending along channels in the device and selectively deflecting the beams toward a phosphor screen on the front wall at a plurality of points. Particularly, the present invention relates to such a display device in which the beams emitted from the guides impinge on the phosphor screen at substantially uniformly spaced points across the entire lateral dimension of the channels.

In my copending application for U.S. Letters Patent, Ser. No. 607,492, filed Aug. 25, 1975, entitled "Flat Electron Beam Addressed Device", now U.S. Pat. No. 4,031,427, issued June 21, 1977, there is described a flat panel display device which includes an evacuated envelope having parallel, substantially flat, rectangular front and back walls secured together in spaced relation by side walls. A plurality of spaced, parallel support walls extend between and are substantially perpendicular to the front and back walls. The support walls serve to provide internal support for the front and back walls against the external atmospheric pressure and divide the interior of the envelope into a plurality of parallel channels which extend along the front and back walls. At one end of each of the channels is a gun structure which is adapted to generate electrons and direct the electrons as beams into the channels along paths parallel to the front wall with each of the channels having therein at least one beam. Along each of the beam paths is a beam focusing guide through which the beam travels along the channel. The focusing guide serves to confine the electrons to the beam as the beam travels along the channel and to selectively deflect the beam toward a phosphor screen on the inner surface of the front wall at a plurality of points along the channel. At each point that the beams are deflected toward the phosphor screen the beams impinge on the screen to achieve a line scan of the screen.

It is desirable to minimize the number of support walls in the envelope so as to minimize the number of parts used to make up the display device and the weight of the display device. More importantly it is desirable to minimize the number of support walls so as to minimize the number of contact lines between the support walls and the front wall which can interfere with the visual display on the phosphor screen.

To minimize the number of the support walls, they are spaced apart a distance such that each channel contains a plurality of beams and therefore a plurality of beam focusing guides. The number of beams in each channel must be such that when the beams are deflected to impinge on the phosphor screen they will excite a line of the phosphor screen which extends laterally across the channel from one of the support walls to the other support wall. Also, the center to center spacing of the beams at their points of impingement should be uniform. However, it is desirable that the focusing guide which extends along the back wall of the envelope, be spaced from the support walls. This spacing is desired to prevent any possible interference with the operation of the focusing guides and to provide room for structure for mounting the focusing guides in the channel. Also, it is desirable that the path from the focusing guide to the phosphor screen of the electron beams closest to the support walls be spaced from the support walls to prevent the beams from charging the support walls. Thus, it would be desirable to have a display device in which although the focusing guides are spaced from the support walls the electron beams emitting from the focusing guides will impinge on the phosphor screen over the entire lateral dimension of the channel from one support wall to the other.

SUMMARY OF THE INVENTION

A display device of the type described includes means in each of a plurality of channels for creating a static electrostatic field which will fan out the paths of at least some of the beams in the channel laterally of the channel as the beams flow from the focusing guide in the channel to the front wall of the envelope of the display device.

DETAILED DESCRIPTION OF THE INVENTION

Figure 1:
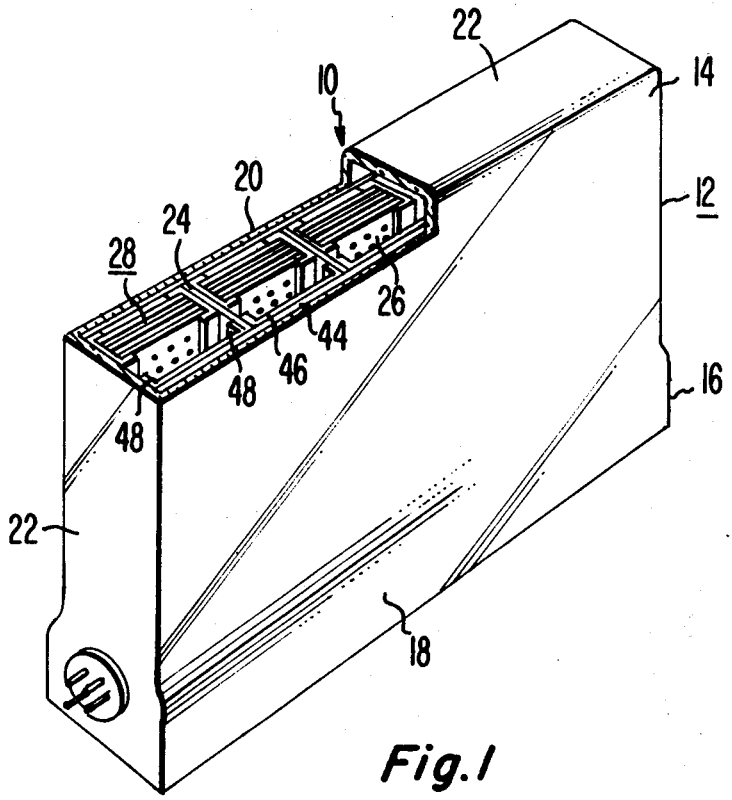
FIG. 1 is a perspective view, partially broken away of a form of the display device of the present invention.

Referring to FIG. 1, one form of a flat display device of the present invention is generally designated as 10. The display device 10 comprises an evacuated envelope 12, typically of glass, having a display section 14 and an electron gun section 16. The display section 14 includes a rectangular front wall 18 which supports the viewing screen, and a rectangular back wall 20 in spaced, parallel relation with the front wall 18. The front wall 18 and back wall 20 are connected by side walls 22. The front wall 18 and back wall 20 are substantially flat and are dimensioned to provide the size of the viewing screen desired, e.g., 75 × 100 centimeters, and are spaced apart about 1 centimeter.

A plurality of spaced, parallel support walls 24 are secured between and are substantially perpendicular to the front wall 18 and the back wall 20 and extend from the gun section 16 to the opposite side wall 22. The support walls 24 provide the desired internal support for the evacuated envelope 12 against external atmospheric pressure and divide the display section 14 into a plurality of parallel channels 26 which extend along the front wall 18 and the back wall 20. In each of the channels 26 are a plurality of focusing guides, each of which serves to confine electrons directed into the channel into a beam which travels a path along the channel. Each guide also includes means for deflecting its beam out of the guide and toward the front wall 18 of the envelope at various points along the length of the channel 26.

Figure 2:
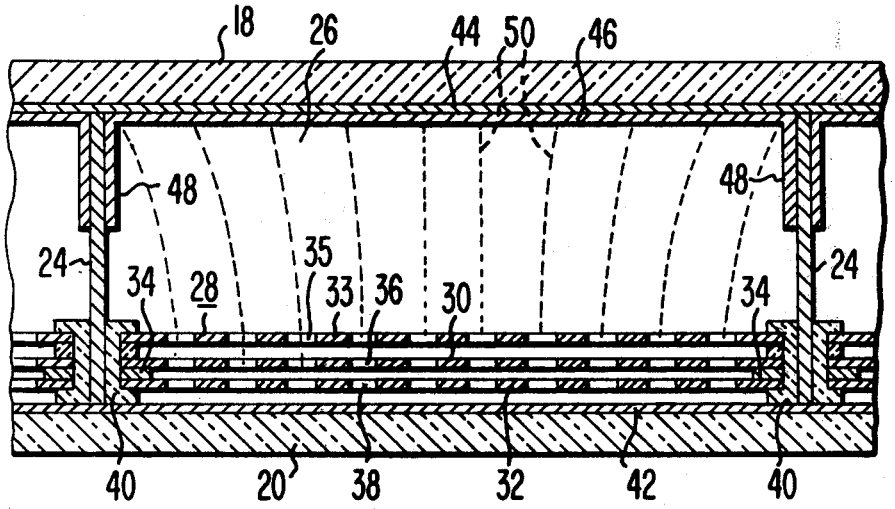
FIG. 2 is a sectional view of the display device transversely across one of the channels in the envelope.

Referring to FIG. 2, the focusing guide shown therein is of the type shown and described in the copending application for U.S. Letters Patent of W. W. Siekanowicz et al, Ser. No. 671,358, filed Mar. 29, 1976, now U.S. Pat. No. 4,088,920, issued May 9, 1978 entitled "Flat Display Device With Beam Guide", and are arranged in an assembly 28 of the type described in the copending application for U.S. Letters Patent of Z. M. Andrevski, Ser. No. 775,300, filed Mar. 7, 1977, now U.S. Pat. No. 4,101,802, issued July 18, 1978 entitled "Flat Display Device With Beam Guide". The assembly 28 includes a pair of rectangular grid plates 30 and 32 secured together in spaced parallel relation by metal spacer members 34 which are between the grid plates along the elongated edges thereof. The grid plates 30 and 32 are secured to the spacer members 34, such as by welding. The grid plates 30 and 32 having a plurality of openings 36 and 38 respectively therethrough. The openings 36 and 38 are arranged in rows both transversely across the channel 26 and longitudinally along the channel with each of the openings 36 being aligned with a separate opening 38. A third grid plate 33 is mounted in spaced parallel relation to the grid plate 30 and is electrically insulated therefrom. The third grid plate 33 has openings 35 therethrough each of which is aligned with a separate opening 36 in the grid plate 30. The assembly 28 is mounted along but spaced from the back wall 20 by track members 40 which are mounted on the back wall 20 along each support wall 24. A plurality of conductors 42 (only one of which is shown) are on the inner surface of the back wall 20 and extend transversely across the channels 26. Each of the conductors 42 extends along a separate transverse row of the openings 36 and 38 in the grid plates 30 and 32 so that the conductors 42 are arranged in parallel spaced relation along the entire length of the channels 26. The conductors 42 are preferably stripes of a conductive metal coated on the inner surface of the back wall 20.

On the inner surface of the front wall 18 is a phosphor screen 44. The phosphor screen 44 may be of any well known type presently being used in cathode ray tubes, e.g. black and white or color television display tubes. For a color display, it is preferable that the phosphor screen 44 be formed of a plurality of regions of phosphors which emit different colors, i.e. red, green and blue. Preferably, a black matrix material extends across the areas of the front wall 18 contacted by the support walls 24. A metal film electrode 46 is on and covers the phosphor screen 44. Metal film fan out electrodes 48 are on the surfaces of the support walls 24 along the entire length of the channels 26. The fan out electrodes 48 contact the electrodes 46 and extend therefrom toward the back wall 20. However, the fan out electrodes 48 extend along only a portion of the distance between the front wall 18 and back wall 20 so that the fan out electrodes are spaced from the assemblies 28.

The gun section 16 is an extension of the display section 14 and extends along one set of adjacent ends of the channels 26. The gun section may be of any shape suitable to enclose the particular gun structure contained therein. The electron gun structure contained in the gun section 16 may be of any well known construction suitable for generating electrons and directing beams of the electrons into the focusing guide assemblies 28 along each of the channels 26. For example, the gun structure may comprise a plurality of individual cathodes mounted at the ends of the channels for generating the electrons and having suitable electrodes for directing the electrons as beams along the channels as described in my copending application, Ser. No. 607,492, now U.S. Pat. No. 4,031,427, issued June 21, 1977. Alternatively, the gun structure may include a line cathode extending along the gun section 16 and across the ends of the channels 26 and adapted to selectively direct individual beams of electrons along the channels. A gun structure of the line type is described in U.S. Pat. No. 2,858,464 to W. L. Roberts, issued Oct. 28, 1958, entitled "Cathode Ray Tube".

In the operation of the display device 10 the gun structure directs a plurality of beams of electrons into each channel 26 along spaced parallel paths between the grid plates 30 and 32 of the assembly 28 and substantially parallel to the front wall 18. As described in the application of W. W. Siekanowicz et al, Ser. No. 671,358, issued May 9, 1978 each longitudinal row of the openings 36 and 38 serves as a separate focusing guide and a separate beam of electrons is directed along each of the focusing guides. Thus, in the display device 10 shown in FIG. 2, there are ten separate focusing guides in each channel 26 so that ten electron beams are directed into each of the channels. A positive potential is applied to each of the grid plates 30 and 32 which potential is lower than the potential applied to the conductors 42 and the third grid plate 33. For example, a potential of about +50 volts may be applied to the grid plates 30 and 32 and about +200 volts to the conductors 42. If the spacing between the third grid plate 33 and the grid plate 30 is the same as the spacing between the grid plate 32 and the conductors 42, a potential of about +200 volts is applied to the third grid plate 33. If the spacing between the third grid plate 33 and the grid plate 30 is greater than the spacing between the grid plate 32 and the conductors 42, the potential applied to the third grid plate 33 is made more positive than +200 volts by an amount necessary to provide an electrostatic field between the third grid plate 33 and the grid plate 30 which corresponds with the electrostatic field between the grid plate 32 and the conductors 42. These potential differences generate electrostatic force fields around each of the beam paths which confine the electrons to the beam as the beam flows through the focusing guide along the channel.

The beams are selectively deflected out of the focusing guides towards the phosphor screen 44 at each transverse row of the opening 36 and 38 in the grid plates 30 and 32 by switching the potential applied to the conductor 42 which is along the transverse row to a negative potential, such as −100 volts. The beams pass through the adjacent transverse row of openings 36 in the grid plate 30 and the openings 35 in the third grid plate 33 and flow toward the phosphor screen 44 as a result of the high positive potential typically about +8,000 to +10,000 volts, on the screen. The beams will impinge on the phosphor screen 44 to provide a line scan of the screen.

As can be seen in FIG. 2, the focusing guides closest to the support wall 44 are spaced a substantial distance from the support walls because of the channel members 40 and the spacer members 34. Thus, if the beams deflected from the focusing guides flow directly to the phosphor screen 44 in the normal manner, they would impinge on the screen at points spaced from the support walls. Thus, the line scan provided by the beams emanating from the focusing guide assembly 28 would not extend the full lateral dimension of the channel 26 so that the visual display would not be complete. However, in the display device 10, the fan out electrodes 48, which are at the same potential as the electrodes 46 and phosphor screen 44 cause the static electrostatic field between the electrode 46 and the assembly 28 to bend toward the fan out electrodes 48 in the regions of the channel 26 adjacent the fan out electrodes. This electrostatic field causes the paths of at least some of the beams to fan out toward the support walls. By adjusting the distance that the fan out electrodes extend away from the phosphor screen 44, the potential applied to the fan out electrodes 48, and the spacing of the focusing guide from the support walls, the beams emitting from the focusing guides closest to the support walls can be directed so as to impinge on the phosphor screen at points close to the support walls. For example, in a display device in which the phosphor screen 44 is spaced from the assembly 28 a distance of about 7.5 millimeters, the fan out electrodes extend from the phosphor screen a distance of about 4.4 millimeters, the phosphor screen and fan out electrodes are at a potential of +10,000 volts, the beams closest to the support walls can be directed to the phosphor screen at the support walls if the focusing guides from which the beams are emitted are spaced from the support walls a distance of about 1.6 millimeters. If the fan out electrodes 48 are shortened or the potential applied thereto is made smaller, there will be less bending of the beams so the focusing guide would have to be moved closer to the support walls to achieve the desired fanning out of the paths of the beams. The electrostatic field from the fan out electrodes will bend any beams which are spaced from the support walls a distance substantially equal to the distance between the phosphor screen and the assembly 28. The further the beam is from the fan out electrode, the less it will be fanned out by the fan out electrodes. This results in a fanning out of the beams as indicated by the dashed line 50 which indicates the paths of the beams. The beams which are beyond the electrostatic fields which are bent by the fan out electrodes 48 will still flow directly to the phosphor screen. Thus, the beams will impinge on the phosphor screen along the entire lateral dimension of the channel to provide a line scan which extends across the channel from one support wall to the other. The third grid plate 33 serves to focus each of the beams and to isolate the beam guides from the electrostatic field of the fan out electrodes 48.

It is often desirable to have a uniform center to center spacing of the electron beams at the phosphor screen. For example, in a display device having a color display with a phosphor screen formed of a plurality of uniformly spaced phosphor strips, it is necessary to have a separate beam impinge on each of the phosphor strips. To achieve such uniformly spaced beams it may be necessary to use an assembly 28 in which the focusing guides are nonuniformly spaced apart with the focusing guides closest to the support walls being more closely spaced than the focusing guides in the center portion of the assembly. This nonuniformity of spacing of the focusing guides will compensate for the nonuniformity of the fanning out of the beams at the surface of the phosphor screen so as to achieve a uniform spacing between the beams at the phosphor screen. If the focusing guides must be uniformly spaced apart, the compensation can be achieved by other types of focusing means positioned between the assembly 28 and the front wall 18.

Although the display device 10 of the present invention is shown and described as having ten focusing guides and beams in each channel, it can have any desired number of beams in each channel depending on the lateral dimensions of the channels and the size of the beam. Also, although the beam paths are indicated by lines, it should be understood that the beams have a cross sectional area so that each beam impinges on a finite portion of the lateral dimension of the phosphor screen. The display device 10 can use focusing guides of types other than that shown. One alternative type of focusing guide which can be used is shown and described in the copending application for U.S. Patent of T. L. Credelle, Ser. No. 607,490, filed Aug. 25, 1975, now U.S. Pat. No. 4,103,204, issued July 25, 1978 entitled "Flat Display Device With Beam Guide".

I claim:

1. A display device comprising:

an evacuated envelope having front and back walls;

a plurality of spaced support walls extending between and substantially perpendicular to said front and back walls forming parallel channels extending along said front and back walls;

means for generating electrons and directing the electrons into said channels as a plurality of beams, along a plurality of beam paths;

a phosphor screen extending across each of said channels;

a beam focusing guide extending along the inner surface of the back wall along each of the beam paths for confining the electrons in said beams and for selectively deflecting said beams toward said screen, said beam focusing guides closest to said support walls being spaced from the support walls so that the beams extend across less than the full lateral dimension of the channels when the beams leave the focusing guides;

a separate fan out electrode at each side of each channel for creating a static electrostatic field which causes at least some of the beams to fan out and extend across the entire lateral dimension of the channels at the phosphor screen as the beams flow from the focusing guides to the screen, said fan out electrodes being on the surface of said support walls, each of said fan out electrodes extending from the phosphor screen but being spaced from the focusing guide and being electrically connected to said screen by a metal film electrode on and covering the phosphor screen and the fan out electrode.

2. A display device in accordance with claim 1 in which the fan out electrodes are dimensioned so as to cause the beams to fan out to provide a uniform center to center spacing between the beams at the phosphor screen.

* * * * *